US006548467B2

(12) United States Patent
Baker et al.

(10) Patent No.: US 6,548,467 B2
(45) Date of Patent: Apr. 15, 2003

(54) SANITIZING COMPOSITIONS AND METHODS

(75) Inventors: Ashley Sutherland Baker, Brussels (BE); Kristien Greta Govers, Kontich (BE); Tiffany Alice Hensman, Newcastle-Upon-Tyne (GB); Peter Gerard Gray, Killingworth (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/084,901

(22) Filed: Feb. 28, 2002

(65) Prior Publication Data

US 2002/0128165 A1 Sep. 12, 2002

Related U.S. Application Data

(63) Continuation of application No. PCT/US00/23964, filed on Aug. 31, 2000.

(51) Int. Cl.[7] ..... C11D 3/00; C11D 3/22; C11D 3/395; C11D 7/18; C11D 7/54

(52) U.S. Cl. ..... 510/312; 510/309; 510/313; 510/220

(58) Field of Search ..... 510/309, 312, 510/220, 313

(56) References Cited

U.S. PATENT DOCUMENTS

| | | | | |
|---|---|---|---|---|
| 5,423,997 A | | 6/1995 | Ahmed et al. | |
| 5,898,025 A | | 4/1999 | Burg et al. | |
| 5,965,505 A | * | 10/1999 | Baillely et al. | 510/311 |

FOREIGN PATENT DOCUMENTS

| | | |
|---|---|---|
| DE | 19 547 730 A1 | 6/1997 |
| EP | 0 313 144 A2 | 4/1989 |

* cited by examiner

*Primary Examiner*—Yogendra N. Gupta
(74) *Attorney, Agent, or Firm*—Julia A. Glazer; Kim William Zerby; Steven W. Miller

(57) ABSTRACT

The invention relates to compositions comprising a peroxy-acid bleach precursor, a peroxide source, at least about 15% by weight of a carbonate source, which may comprise the hydrogen peroxide source or part thereof, and at least about 7% by weight of an organic carboxylic acid whereby a 1% solution of the composition in demineralised water provides a pH from 8.8 to 9.9. The compositions are useful to provide sanitization of fabrics, in particular to reduce the activity of certain bacteria groups.

20 Claims, No Drawings

SANITIZING COMPOSITIONS AND METHODS

CROSS REFERENCE TO RELATED APPLICATIONS

This is a continuation of International Application PCT/US00/23964 with an international filing date of Aug. 31, 2000, published in English under PCT Article 21(2) which claims benefit of Great Britain Application No. 9920678.1, filed Sep. 2, 1999.

TECHNICAL FIELD

This invention provides specific sanitizing compositions and methods for improved sanitization of fabrics.

BACKGROUND OF THE INVENTION

Traditionally, hard-surface cleaners contain bleach as cleaning agent and disinfectant. They generally contain high levels of chlorine bleach to achieve the required cleaning and disinfecting properties.

Research has shown that hydrogen peroxide bleach in laundry and dishwashing detergents also has a disinfecting action and, more recently, detergent manufacturers have become interested in the disinfecting properties of these detergents. Peroxyacid bleach precursors are also known to provide antimicrobial action.

However, not all bleach systems which have sufficient disinfecting properties are suitable for detergents: bleach is not always compatible with other detergent ingredients, such as enzymes, or moreover, the levels of bleach required to obtain disinfecting are too high and may damage the fabrics.

The inventors found that peroxyacid bleach precursors can be the preferred bleach species to deliver sanitization of fabrics during the wash. They found however that a problem with these bleach precursors is that they form the peroxyacid bleach at a high, alkaline pH, but that at such a high, alkaline pH the peroxyacid, which is found to be the active species which gives the sanitization benefits, dissociates to the inactive form, resulting thus in reduced sanitization.

Also, a preferred bleaching ingredient in detergents is a percarbonate salt. The percarbonate makes the solution very alkaline, which is as set out above is not desirable when aiming to keep high levels of the active species, i.e. the peroxyacid itself, and thus the antimicrobial performance thereof. Also many builders provide an alkaline pH in the wash, which is not desirable when seeking an efficient sanitization.

Moreover, many detergent ingredients also require high alkaline pH conditions in the wash, which are not compatible with the preferred pH of the wash required to have a high level of peroxyacid.

Thus it is difficult to formulate detergents in such a way that preferably small amounts of peroxyacid bleach precursors provide efficient sanitization whilst at the same time excellent cleaning is achieved.

The inventors have now found a way to provide efficient antimicrobial performance and or sanitization whilst a good cleaning of both bleachable and non-bleachable stains is achieved. They found that when the pH of the detergent in the wash water is controlled, namely from 8.8 and 9.9, preferably from 9.0 or even 9.2 to 9.85 or even to 9.8, in particular achieved by using specific levels of acid and alkaline ingredients and optionally buffers, excellent sanitization and cleaning is obtained, whilst only limited amounts of precursor are required, making the compositions more storage stable and safer to use. They found that these detergent compositions could then even contain percarbonate bleach.

The specific compositions of the invention are preferably used to effectively provide sanitization of fabrics or, effectively inactivate microorganisms, in particular bacteria which are difficult to inactivate, such as in particular *E. Hirae*, but also *S. Aureus, E. Coli* and *Ps Aeruginosa*.

SUMMARY OF THE INVENTION

The invention relates to laundry or dishwashing detergent composition comprising, at least 15% by weight of a carbonate source and a bleach system which contains at least 2.5% by weight of a peroxyacid bleach precursor and a hydrogen peroxide source, which may include a salt of a percarbonate and may thus be part of the carbonate source, and at least 7% by weight of an acid, preferably an organic acid, more preferably including an organic carboxylic acid, characterized in that a 1% by weight mixture of the composition in demineralised water of a temperature of 20° C. obtained after 10 minutes stirring at a speed of 200 rpm, provides a pH from 8.8 to 9.9.

The invention also relates to a method of providing sanitization during the wash by use of a composition of the invention and a method for inactivate *E. Hirae, S. Aureus, E. Coli* and *Ps Aeruginosa*.

The inventors have also found that, when the laundry and dishwashing compositions of the invention are for use in automatic laundry methods, improved antimicrobial performance or sanitization of the fabrics is achieved when the composition is delivered directly into the drum of the washing machine, for example by use of a dispensing device. One embodiment of the invention thus relates to a washing method for washing fabrics whereby a the composition of the invention is introduced into the drum of a washing machine by placing a dispensing device comprising the composition in the drum prior to the introduction of wash water. All documents cited herein are hereby incorporated by reference.

DETAILED DESCRIPTION OF THE INVENTION

The composition of the invention is preferably such that a 1% mixture of the composition in demineralised water, at a temperature of 20° C., obtained after 10 minutes stirring at a speed of 200 rpm, provides a pH from 9.0 to 9.85 or even from 9.2 to 9.85 or even to 9.8, or even from 9.4 to 9.8. The pH is measured after stirring the mixture, for 10 minutes at a constant temperature, by any conventional pH measurement method.

As used herein the term "1% mixture" refers to any mixture, dispersion or solution of 1 weight unit of the composition in 99 weight units of demineralised water, and it is thus to be understood that if the composition is not dissolved fully after 10 minutes, the pH is measured of such a mixture or dispersion.

As used herein, "reduction of the activity of the microorganisms" includes a reduction of the activity as defined in the CEN method prEN1276, 1993, (Comite Europeen de Normalisation) and CEN method prEN 1650. The reduction therein is preferably represented by a reduction of the specific microorganism or bacteria by at least more preferably at least $2\times10^5$, or even $3\times10^5$.

The reduction of the activity of the microorganisms when used herein includes the reduction of any of the processes conducted by the microorganism, including secretion of products but preferably the growth of the microorganisms.

The invention also provides a method for reduction of the activity of microorganisms, or preferably specific bacteria, comprising the steps of contacting the microorganism with an aqueous liquor comprising the composition of the invention such that the peroxyacid provided by the precursor is present at a level of at least 100 ppm in the liquor, per $10^6$ microorganisms.

Preferably, the composition is such that at least the activity of *E. Hirae*, but more preferably also of *S. Aureus, E Coli* and *Ps Aeruginosa*, is reduced by at least $10^5$, preferably at least $2\times10^5$ or even $3\times10^5$, as measured by the above CEN method.

In particular, the activity reduction is done during a laundering process. Hereby, the composition of the invention can be contacted with the specific microorganisms in solid form, but preferably the bleaching agent is present in a liquor in contact with the microorganisms.

The specific microorganisms, preferably the specific bacteria, can be present on the surfaces or fabrics to be cleaned and sanitized, for example on the fabrics to be cleaned in a laundry process. The bacteria can also be present in the liquor used for the cleaning or sanitization process or in the equipment used in the process, such as the washing machine or dispensing device.

The composition of the invention is particularly useful in inactivating microorganisms having cell walls comprising relatively high levels of peptidoglycan, in particular gram positive bacteria, which can be present in soils or stains on the fabrics or surfaces, in particular in body soils.

The amount of composition required to obtain effective reduction of the activity of the specific microorganisms depends on various factors, such as the amount of microorganisms present, the conditions of the sanitization or cleaning process, including the other compounds present and the temperature of the cleaning process.

In the method of the invention, the liquor used preferably comprises at least 100ppm of the peroxyacid per $10^6$ microorganisms, more preferably at least 200 ppm or even 250 ppm.

The reduction of the activity of the specific microorganisms, having a peptidoglycan-containing cell walls can be determined by the Petrocci and Clarke method, as described in JOAC 1981, but is preferably determined for the purpose of this invention by the CEN method prEN1276, 1993 for bacteria and CEN method prEN1650 for yeast.

Such a CEN method involves, for example, the preparation of gram positive bacterial inocula conform the CEN method, pages 7 and further, preparation of a solution comprising the hydrophobic bleaching agent at a level of about 250 ppm, conducting the test following the CEN method, incubation TSA plates for 24 hours at 36° C.; and subsequently counting of the bacteria colonies on the plates.

This is compared with the results of the reference and the reduction of bacteria growth is calculated, for the defined contacting time.

Acids

The composition comprises at least 7% by weight of one or more acids, preferably an organic acid, preferably including at least an organic carboxylic acid. The exact levels will depend on the other ingredients of the detergent composition and the alkalinity thereof, so that the level of the acid is adjusted to provide the required pH.

Preferably the acid is present at a level of at least 8% by weight of the composition or even at least 9% or even at least 10% by weight of the composition, with as upper limit a level of preferably 30% or even 20% by weight of the composition.

Suitable acids to be used herein include materials or which not only help to provide the required pH of the formulation, but which also have a secondary function in the composition, such as acting as a chelating agent, builder and/or effervescence source. Useful inorganic acids include boric acid, bisulphite salts and bisulphite salts, preferably sodium salts thereof.

Preferably, the acid comprises at least an organic carboxylic acid. Such acids include mono- or polycarboxylic acids preferably citric acid, adipic acid, glutaric acid, 3 chetoglutaric acid, citramalic acid, tartaric acid, maleic acid, fumaric acid, malic acid, succinic acid, malonic acid but also polymeric or oligomeric polycarboxylic acids, such as acrylic acid polymers or maleic acid polymers, or copolymers of maleic acid and acrylic acid.

Most preferably the organic carboxylic acid herein comprises at least 7% by weight of the composition of maleic acid, malic acid or citric acid, or mixtures thereof.

It may be preferred that mixtures of organic carboxylic acids and inorganic acids are used, for example in ratios of from 1:1 to 10:1 or even from 2:1 to 5:1.

The acid may be present as separate components or in solid compositions of the invention. The acid may be incorporated in a granule together with other detergent ingredients. In the latter case, it may be preferred that the acid is a particulate material whereof at least 75%, preferably at least 85% or even at least 90% or even at least 95% or even at least 99% by volume, has a particle size from 1 to 500 microns and more preferably from 1 to 350 microns and it may even be preferred that at least 65% or even at least 75% or even at least 85% has a particle size from 1.0 to 250 microns or even from 1.0 to 150 microns.

These particle sizes can be determined by any method known in the art, in particular by laser light scattering or diffraction technique, such as with Male 2600 or Sympatec Helos laser light scattering equipment (or defractometer).

When the acid is present as a separate particle in a solid composition of the invention, the particle size distribution and mean is preferably similar to the particle size distribution and the mean of the other components of the composition, as described hereinafter.

Salts of inorganic acids and/or salts or esters of organic carboxylic acids may also be present as additional components, in particular because it may be beneficial to thus buffer the composition at the required pH. For example, it may be preferred that the composition comprises a salt of citric acid, maleic acid, malic acid, glutaric acid or tartaric acid or borate salt, or mixtures thereof.

Carbonate Source

The compositions of the present invention comprise at least about 15% by weight of a carbonate source. Preferred carbonate sources include carbonate, bicarbonate and percarbonate salts and preferably the carbonate source comprises a mixture of three salts.

It is to be understood that the percarbonate salt when present, forms part of both the carbonate source and the hydrogen peroxide source as defined herein. Thus, in a preferred embodiment of the invention, the composition comprises a percarbonate salt to provide hydrogen peroxide and carbonate. For example, when the composition comprises at least about 10% by weight of a percarbonate salt, as hydrogen peroxide source and carbonate source, the composition also contains at least about 5% by weight of another carbonate source.

The level of carbonate sources will depend on the nature of the detergent. Also, if percarbonate salt is used as a hydrogen peroxide source, reduced levels of other carbonate sources may only be needed. Preferably, the composition comprises a mixture of carbonate sources, preferably including a carbonate salt, bicarbonate salt and percarbonate salt. Then, the composition comprises preferably at least about 5% by weight of a carbonate salt, at least about 2% by weight of a bicarbonate salt and at least about 8% by weight of a percarbonate salt, more preferably at least 7% by weight of a carbonate salt, at least 4% by weight of a bicarbonate salt, and at least about 15% by weight of a percarbonate salt.

Suitable carbonate sources to be used herein include carbonate and hydrogen carbonate or bicarbonate of earth alkali or alkali metals and sodium and potassium salts. The inventors found that it may be particularly useful to include a bicarbonate salt into the compositions, because it has been found that the bicarbonate salt provides a buffered pH at around the pH value needed to form the peroxyacids from the precursors, for example of TAED as described hereinafter.

In a preferred embodiment of the invention, the composition comprises at least 1%, preferably a at least 2% or even at least 4% by weight of the composition of an alkali or earth alkali salt of bicarbonate, preferably sodium bicarbonate. This salt may be present up to any level, preferably up to 20% by weight of the composition, more preferably up to 15% or even up to 10% by weight of the composition.

The carbonate, bicarbonate and percarbonate salts herein my be present as separate particulate components or may be incorporated in detergent granules together with other detergent ingredients.

The carbonate and bicarbonate material, when present in other detergent granules, may preferably have a volume median particle size from 1 to 500 microns, whereby preferably at least 60%, preferably at least 70% or even at least 80% or even at least 90% by volume, have a particle size of from 0.5 to 1180 microns. More preferably, the carbonate or bicarbonate salts have a volume median particle size of 10 to 375, whereby preferably at least 60%, or even at least 70% or even at least 80% or even at least 90% by volume, have a particle size of from 1 to 850 microns; or even preferably a volume median particle size from 10 to 250 microns, whereby preferably at least 60%, preferably at least 70% or even at least 80% or even at least 90% by volume, has a particle size of from 5 to 425 microns.

It may be preferred that the required particle size of the carbonate and/or bicarbonate salt is obtained by grinding a larger particle size material, optionally followed by selecting the material with the required particle size by any suitable method.

Preferably, the carbonate source is incorporated in the composition in such a manner that it is capable to react with the acid to provide effervescing upon contact with water.

Hydrogen Peroxide Source

The compositions of the invention comprise a hydrogen peroxide source. Preferably, this is a persalt such a salts of percarbonate, perborate, perphosphate, peroxymonopersulfate and persilicate salts. The inorganic perhydrate salts are normally the alkali metal salts. The alkali metal salt of percarbonate, perborate, or mixtures thereof, is the preferred inorganic perhydrate salts for use herein. Preferred perborate is sodium perborate in the form of the monohydrate or tetrahydrate, respectively of nominal formula $NaBO_2H_2O_2$ and $NaBO_2H_2O_2 \cdot 3H_2O$. Other suitable oxygen bleaches include persulphates, particularly potassium persulphate $K_2S_2O_8$ and sodium persulphate $Na_2S_2O_8$.

Highly preferred is an alkali metal salt of percarbonate, preferably sodium percarbonate, which then also forms part of the carbonate source, described above.

Typically, the compositions in the present invention comprise from 5% to 50% by weight of the total composition of a hydrogen peroxide source, preferably from 10% to 45% and more preferably from 15% to 35% by weight or even from 17% or even 19% to 30% or even to 25% by weight of the composition.

The persalts may be coated by any coating material, preferably comprising a sulphate salt, such as magnesium sulphate or preferably sodium sulphate, carbonate or bicarbonate salt or mixtures thereof.

Preferred persalts and methods for making them are described in for example WO97/35951, WO96/14388, WO97/19890, WO94/02568, EP891417-A, EP681557A.

Bleach Precursors

The granular compositions herein comprise a peroxyacid bleach precursor. Preferably, the peroxyacid bleach precursor is present at a level of from 3% to 10% or even 3.5% to 8% or even 4% to 6% by weight of the composition.

Peroxyacid bleach precursors are compounds which react with hydrogen peroxide in a perhydrolysis reaction to produce a peroxyacid. Generally peroxyacid bleach precursors may be represented as

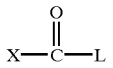

where L is a leaving group and X is essentially any functionality, such that on perhydroloysis the structure of the peroxyacid produced is

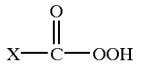

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

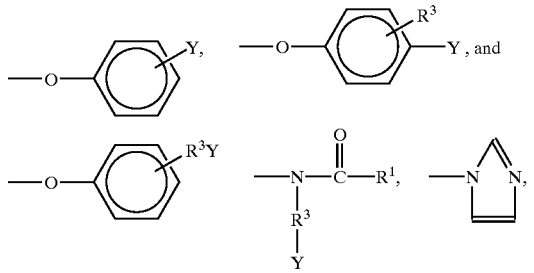

-continued

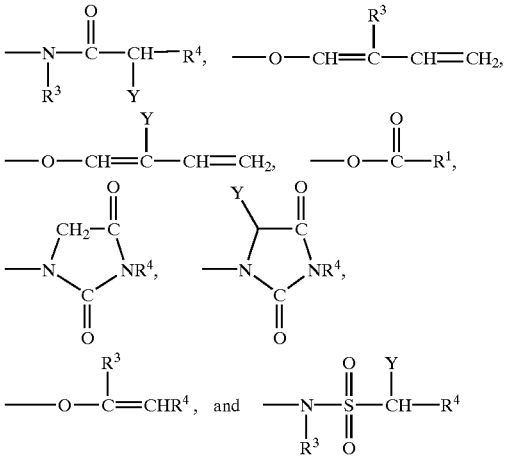

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammmonium groups.

The preferred solubilizing groups are $—SO_3^-M^+$, $—CO_2^-M^+$, $—SO_4^-M^+$, $—N^+(R^3)_4X^-$and $O<—N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Preferred examples of such compounds are tetracetyl ethylene diamine, (TAED), sodium 3,5,5 trimethyl hexanoyloxybenzene sulphonate, nonylamide of peroxyadipic acid and n-nonanoyloxybenzenesulphonate (NOBS), -decanoyloyloxybenzenesulphonate, dodecanoyloxybenzenesulphonate and acetyl triethyl citrate (ATC), Phenolsulphonate Ester of N-nonanoyl-6-aminocaproic acid, aliphatic diacyl peroxide (DAP) having the general formula R—C(O)—O—O—(O)C—R1, wherein R and R1 can be the same or different and are linear or branched aliphatic groups having from 6 to 20 carbon atoms.

Also particularly preferred are N-acyl caprolactam selected from the group consisting of substituted or unsubstituted benzoyl caprolactam, octanyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam.

Examples of other suitable compounds are disclosed in British Patent GB 1 586 769, GB 2 143 231, U.S. Pat. Nos. 4,818,425 and 4,259,201.

Amide substituted alkyl peroxyacid precursor compounds are suitable herein, including those of the following general formulae:

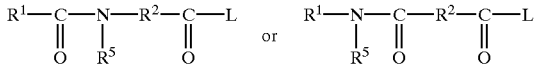

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group, preferably a oxybenzene sulfonate. Amide substituted bleach activator compounds of this type are described in EP-A-0170386. Nonanamido caproyl oxybenzene sulfonate, preferably in the form of the sodium salt, NACA-OBS, is a preferred precursor of this type.

A highly preferred bleach precursor herein is TAED, NACA-OBS, DOBS and/or NOBS. The compositions herein may comprise mixtures of said bleach activators, because it has been found that this may result in improved sanitization. Highly preferred is a mixture of TAED and a precursor selected from NOBS, DOBS or NACA-OBS. It has been found that further improved sanitization is achieved when such mixed precursor systems are used, in particular when the ratio of TAED to NOBS, DOBS or NACA-OBS is from 1:2 to 2:1.

The precursor may be in the form of a separate detergent granule, which may be coated, or in the form of a detergent granule comprising other detergent actives. It preferably is present in the form of a particulate component having a similar particle size distribution and mean particle size as the other detergent particles.

The inventors also found that it can be beneficial when the precursor and hydrogen peroxide source are intimately mixed with one another, for example in a granule. This mixture or granule is preferably substantially free of organic acids.

It should be understood that for the purpose of the invention, the peroxy acid form of the precursor is not part of the acid component of the composition of the invention.

Laundry and Dishwashing Method

Machine laundry methods herein typically comprise treating soiled laundry or dishes with an aqueous wash solution in a washing machine having dissolved or dispensed therein an effective amount of a detergent in accord with the invention. In particular laundry washing methods are envisaged herein. For example, an effective amount of the laundry detergent composition for laundry washing normally means about 10 g to 300 g of product dissolved or dispersed in a wash solution having a volume of about 5 to 65 liters. These are typical product dosages and wash solution volumes commonly employed in conventional machine laundry methods. Dosage is dependent upon the particular conditions such as water hardness and degree of soiling of the soiled laundry.

The reduction of the activity of the microorganisms present in the wash and on the soiled fabrics preferably takes place during a washing method, preferably a automatic or hand laundry, at low temperatures up to 60° C. or even up to 45° C. or even around 30° C.

The detergent composition may be dispensed for example, from the drawer dispenser of a washing machine or may be sprinkled over the soiled laundry placed in the machine.

In one highly preferred use aspect a dispensing device is employed in the washing method, to introduced the composition of the invention directly in the drum of the wash. It has been found that improved sanitization is then achieved.

Any dispensing device can be used, including those described in the following patents; GB-B-2, 157, 717, GB-B-2, 157, 718, EP-A-0201376, EP-A-0288345 and EP-A-0288346, WO94/11562.

Detergent Compositions

The compositions of the present invention can be prepared with different bulk densities, preferably being from about 300 to 1200 g/l, more preferably from about 500 to 1100 g/l, and even more preferably from about 550 g/l to 900 g/l. These compositions are preferably solid compositions and more preferably solid laundry detergents, which can be made by a variety of methods well known in the art. These methods include but are not limited to dry-mixing, spray drying, extrusion, roller compaction, agglomeration, and combinations thereof. The solid compositions may have any form. Preferably they are granular or in the form of a tablet or bar.

It is preferred that the composition be made by mixing all or part of the granules, including those made by agglomeration or spray-drying, and subsequently adding a binder and mixing or agglomerating the granules and binder to form the, preferably agglomerated detergent granules. These may be of the required particle size or they may be sieved to obtain particles of the required size.

In a highly preferred embodiment, the acid, or part thereof, and the carbonate source or part thereof, are present in an intimate mixture with one another, preferably in a granule, which means for the purpose of the invention that the acid and carbonate source are preferably homogeneously mixed. For optimum effervescence in aqueous medium the weight ratio of acid to carbonate source in the intimate mixture or the effervescent granule is preferably from about 0.1 to 10, more preferably from about 0.5 to 2.5, and even more preferably from about 1 to 2.

The acid is preferably present in such a granule at a level of from about 5% to 85% by weight of the total granule, more preferably from about 10% to 75%, even more preferably from about 15% to 60%, and most preferably from about 10% to 50%.

The carbonate source is preferably present in such a granule at a level of from about 5% to 90% by weight of the total, preferably from about 10% to 80%, more preferably from about 20% to 75% and most preferably from about 30% to 65%.

The granule is preferably substantially free of water, i.e.; no water has been added or is present other than the moisture of the raw materials themselves. Typically, the level of water is below about 5% by weight of the total intimate mixture or granule, preferably below about 3% and more preferably below about 1.5%.

A desiccant may be present in the intimate mixture or the granule. Examples of suitable desiccants include but are not limited to overdried inorganic and organic salts, anhydrous salts, in particular overdried silicates and aluminosilicates, anhydrous silicates, and/or sulphate salts.

The granules are preferably obtainable by a process comprising a granulation step, preferably comprising the step of dry-powder compaction or pressure agglomeration. While all binding mechanisms can occur in pressure agglomeration, adhesion forces between the solid particles, i.e., between the acid, carbonate source and optionally the binder if present, play an especially important role. This is because pressure agglomeration, especially high pressure agglomeration, is an essentially dry process that forms new entities (i.e., dry effervescent granules) from solid particles (i.e., the acid, bicarbonate, carbonate source and optionally the binder) by applying external forces to densify a more or less defined bulk mass or volume and create binding mechanisms between the solid particles providing strength to the new entity, i.e.; the high external force applied brings the solid particles closely together.

The effervescent granules may optionally comprise a binder or a mixture thereof. Typically, the granules comprise up to about 50% by weight of the total granule of a binder or a mixture thereof, preferably up to about 35%, and more preferably up to about 20%. Suitable binders for use herein are those known to those skilled in the art and include anionic surfactants like C6–C20 alkyl or alkylaryl sulphonates or sulphates, preferably C8–C20 aklylbenzene sulphonates, cellulose derivatives such as carboxymethylcellulose and homo- or co-polymeric polycarboxylic acid or their salts, nonionic surfactants, preferably C10–C20 alcohol ethoxylates containing from 5–100 moles of ethylene oxide per mole of alcohol and more preferably the C15–C20 primary alcohol ethoxylates containing from 20–100 moles of ethylene oxide per mole of alcohol. Of these, tallow alcohol ethoxylated with 25 moles of ethylene oxide per mole of alcohol (TAE25) or 50 moles of ethylene oxide per mole of alcohol (TAE50) are preferred. Other preferred binders include the polymeric materials like polyvinylpyrrolidones with an average molecular weight of from about 12,000 to 700,000 and polyethylene glycols with an average weight of from about 600 to 10,000. Copolymers of maleic anhydride with ethylene, methylvinyl ether, methacrylic acid or acrylic acid are other examples of polymeric binders. Others suitable binders include C10–C20 mono and diglycerol ethers as well as C10–C20 fatty acids.

The effervescent granules may have any particle size, with the preferred particle size dependent upon the application and the component of the granule.

The inventors have found that it can be beneficial for the sanitization and cleaning performance that the acid herein is separated from the precursor and preferably any other bleach components present including any hydrogen peroxide source, such as percarbonate salt, if present. Thus, the effervescing granules described above, preferably comprise no percarbonate salt as carbonate source, but preferably comprise carbonate salts and/or bicarbonate salts.

In a preferred embodiment, the composition preferably comprises granules whereof at least about 60%, and preferably at least about 80% by weight have an average particle size, by weight, of from about 400 microns to 1400 microns, preferably from about 500 microns to 1100 microns, and more preferably from about 750 to 1000 microns. It may be preferred that the compositions comprises less than about 20% or even less than about 10% or even less than about 5% by weight of particulate components for a particle size less than about 300 microns, or even less than about 425 microns, or even less than about 600 microns. It is also preferred that the composition comprise less than about 20%, or less than about 10%, or even less than about 5% by weight of the composition, of particulate components of a particle size of more than about 1700 microns, or even more than about 1400 microns, or even more than about 1180 microns.

Thus, the compositions may comprise different granular components, wherein each have the above particle size requirements, and thus have a similar particle size distribution and mean particle size.

The inventors found that improved sanitization is achieved when the composition contains perfumes or perfume components with a high fabric substantivity. While not wishing to be bound by theory, it is believed that this is due to the perfume oils which remain on the surface of the washed fabric and which can thus provide sanitization during the subsequent use of the fabric.

Such preferred perfume granules of encapsulated perfume oils are described in co-pending European patent application 98870137.1. Preferred levels of perfume granules will depend on the level of perfume oils therein, but generally the level is from about 0.05 to 8% or even 0.5% to 5% or even 0.8% to 3% by weight of the composition. Moreover, preferably the composition also comprises perfume components which are not in the form of encapsulated perfume oil granules, but preferably in the form of perfume components sprayed onto the detergent granules of the composition.

The compositions herein preferably contain one or more additional detergent components selected from surfactants, bleach catalysts, additional builders, additional organic polymeric compounds, enzymes, suds suppressors, lime soap, dispersants, soil suspension and anti-redeposition agents, soil releasing agents, brighteners, photobleaching agents, and additional corrosion inhibitors.

It is to be understood that the levels of detergent ingredients are to be chosen such that the pH of 1% by weight of composition in demineralised water is as defined above. For example, it may be preferred that when crystalline layered silicates or amorphous silicates are used, the level thereof is up to about 12% by weight or even up to about 10% by weight.

Surfactant

The detergent compositions herein preferably contain one or more surfactants. The surfactant may comprise any surfactant known in the art selected from anionic, nonionic, cationic, ampholytic, amphoteric, and zwitterionic surfactants and mixtures thereof.

It should be understood that for the purpose of the invention, the detergent composition may comprise surfactant which is not present in the intimate mixture with the crystalline-layered silicate, but present in the other detergent components.

Anionic Surfactant

The compositions in accord with the present invention preferably comprise an anionic surfactant. Essentially any anionic surfactant useful for detersive purposes can be comprised in the detergent composition. These can include but are not limited to salts (including, for example, sodium, potassium, ammonium, and substituted ammonium salts such as mono-, di- and triethanolamine salts) of the anionic sulfate, sulfonate, carboxylate, and sarcosinate surfactants. Anionic sulfate and sulfonate surfactants are preferred.

Highly preferred are surfactants systems comprising a sulfonate and a sulfate surfactant, preferably a linear or branched alkyl benzene sulfonate and alkyl ethoxylsulfates, as described herein, preferably combined with a cationic surfactant as described herein.

Highly preferred herein are anionic sulfonate surfactants. Particularly suitable for use herein include the salts of $C_5$–$C_{20}$ linear or branched alkylbenzene sulfonates, but also alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof. Most preferred are $C_9$–$C_{14}$ linear alkyl benzene sulfonates.

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N-($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and/or sulfonate and alkyl ethoxysulfate surfactants. Such mixtures have been disclosed in PCT Patent Application No. WO 93/18124.

Highly preferred herein, in particular for providing an improved surfactant performance, are alkyl chain, mid-chain branched surfactant compounds of the formula $$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_z$$

wherein the total number of carbon atoms in the branched primary alkyl moiety of this formula (including the R, $R^1$, and $R^2$ branching) is from 13 to 19; R, $R^1$, and $R^2$ are each independently selected from hydrogen and $C_1$–$C_3$ alkyl (preferably methyl), provided R, $R^1$, and $R^2$ are not all hydrogen and, when z is 0, at least R or $R^1$ is not hydrogen; w is an integer from 0 to 13; x is an integer from 0 to 13; y is an integer from 0 to 13; z is an integer from 0 to 13; and w+x+y+z is from 7 to 13.

The most preferred mid-chain branched surfactants compounds for use in the detergent compositions herein are mid-chain branched primary alkyl sulfonate and, even more preferably, sulfate surfactants. It should be understood that for the purpose of the invention, it may be preferred that the surfactant system comprises a mixture of two or more mid-chain branched primary alkyl sulfate or sulphonate surfactants.

Preferred mid-chain branched primary alkyl sulfate surfactants are of the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_zOSO_3M$$

These surfactants have a linear primary alkyl sulfate chain backbone (i.e., the longest linear carbon chain which includes the sulfated carbon atom) which preferably comprises from 12 to 19 carbon atoms and their branched primary alkyl moieties comprise preferably a total of at least 14 and preferably no more than 20, carbon atoms. In the surfactant system comprising more than one of these sulfate surfactants, the average total number of carbon atoms for the branched primary alkyl moieties is preferably within the range of from greater than 14.5 to about 17.5. Thus, the surfactant system preferably comprises at least one branched primary alkyl sulfate surfactant compound having a longest linear carbon chain of not less than 12 carbon atoms or not more than 19 carbon atoms, and the total number of carbon atoms including branching must be at least 14, and further the average total number of carbon atoms for the branched primary alkyl moiety is within the range of greater than 14.5 to about 17.5.

R, $R^1$, and $R^2$ are each independently selected from hydrogen and $C_1$–$C_3$ alkyl group (preferably hydrogen or $C_1$–$C_2$ alkyl, more preferably hydrogen or methyl, and most preferably methyl), provided R, $R^1$, and $R^2$ are not all hydrogen. Further, when z is 1, at least R or $R^1$ is not hydrogen.

Preferred mono-methyl branched primary alkyl sulfates are selected from the group consisting of: 3-methyl pentadecanol sulfate, 4-methyl pentadecanol sulfate, 5-methyl pentadecanol sulfate, 6-methyl pentadecanol sulfate, 7-methyl pentadecanol sulfate, 8-methyl pentadecanol sulfate, 9-methyl pentadecanol sulfate, 10-methyl pentadecanol sulfate, 1-methyl pentadecanol sulfate, 12-methyl pentadecanol sulfate, 13-methyl pentadecanol sulfate, 3-methyl hexadecanol sulfate, 4-methyl hexadecanol sulfate, 5-methyl hexadecanol sulfate, 6-methyl hexadecanol sulfate, 7-methyl hexadecanol sulfate, 8-methyl hexadecanol sulfate, 9-methyl hexadecanol sulfate, 10-methyl hexadecanol sulfate, 1-methyl hexadecanol sulfate, 12-methyl hexadecanol sulfate, 13-methyl hexadecanol sulfate, 14-methyl hexadecanol sulfate, and mixtures thereof.

Preferred di-methyl branched primary alkyl sulfates are selected from the group consisting of: 2,3-methyl tetradecanol sulfate, 2,4-methyl tetradecanol sulfate, 2,5-methyl tetradecanol sulfate, 2,6-methyl tetradecanol sulfate, 2,7-methyl tetradecanol sulfate, 2,8-methyl tetradecanol sulfate, 2,9-methyl tetradecanol sulfate, 2,10-methyl tetradecanol sulfate, 2,11-methyl tetradecanol sulfate, 2,12-methyl tetradecanol sulfate, 2,31-methyl pentadecanol sulfate, 2,4-methyl pentadecanol sulfate, 2,5-methyl pentadecanol sulfate, 2,6-methyl pentadecanol sulfate, 2,7-methyl pentadecanol sulfate, 2,8-methyl pentadecanol sulfate, 2,9-methyl pentadecanol sulfate, 2,10-methyl pentadecanol sulfate, 2,11-methyl pentadecanol sulfate, 2,12-methyl pentadecanol sulfate, 2,13-methyl pentadecanol sulfate, and mixtures thereof.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic surfactant can be present in the detergent compositions. It is preferred that the level of ethoxylated nonionic surfactants in the intimate mixture be below about 10% by weight of the mixture and preferably below about 5% by weight.

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Cationic Surfactants

Suitable cationic surfactants to be used herein include the quaternary ammonium surfactants. Preferably the quaternary ammonium surfactant is a mono $C_6$–$C_{16}$, preferably $C_8$–$C_{14}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is, a preferably water dispersible compound having surfactant properties comprising at least one ester (i.e. —COO—) linkage and at least one cationically charged group.

Suitable cationic ester surfactants, including choline ester surfactants, are disclosed in U.S. Pat. Nos. 4,228,042, 4,239,660, and 4,260,529.

Bleach Catalyst

The composition herein can contain a transition metal containing bleach catalyst.

One suitable type of bleach catalyst is disclosed in U.S. Pat. No. 4,430,243. Other types of bleach catalysts include the manganese-based complexes disclosed in U.S. Pat. Nos. 5,246,621 and 5,244,594. Preferred examples of these catalysts include $Mn^{IV}{}_2(u\text{-}O)_3$(1,4,7-trimethyl-1,4,7-triazacyclononane)$_2$-$(PF_6)_2$, $Mn^{III}{}_2(u\text{-}O)_1$ $(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4$-$(ClO_4)_2$, $Mn^{III}Mn^{IV}{}_4(u\text{-}O)_1(u\text{-}OAc)_2$-(1,4,7-trimethyl-1,4,7-triazacyclononane)$_2$-$(ClO_4)_3$, and mixtures thereof. Others are described in European Patent Application publication No. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

The bleach catalysts useful herein may also be selected as appropriate for the present invention. For examples of suitable bleach catalysts see U.S. Pat. Nos. 4,246,612 and 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$.

Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

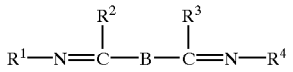

wherein $R^1$, $R^2$, $R^3$, and $R^4$ can each be selected from H, substituted alkyl and aryl groups such that each $R^1$—N=C—$R^2$ and $R^3$—C=N—$R^4$ form a five or six-membered ring. Said ring can further be substituted. B is a bridging group selected from O, S. $CR^5R^6$, $NR^7$ and C=O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II)

perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other examples include binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]\text{-}(ClO_4)_3$.

Other bleach catalysts are described, for example, in European Patent Application, publication No. 408,131 (cobalt complex catalysts), European Patent Applications, publication Nos. 384,503, and 306,089 (metallo-porphyrin catalysts), U.S. Pat. No. 4,728,455 (manganese/multidentate ligand catalyst), U.S. Pat. No. 4,711,748 and European Patent Application, publication No. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian Pat. No. 866,191 (transition metal-containing salts), U.S. Pat. No. 4,430,243 (chelants with manganese cations and non-catalytic metal cations), and U.S. Pat. No. 4,728,455 (manganese gluconate catalysts).

Builder Material

In addition to the organic carboxylic acids, which may act as builders, and the carbonate salts, which may act as builders, the detergent compositions of the invention preferably comprise additional water-soluble and/or water insoluble builder material. Preferred are silicates, aluminosilicates, crystalline-layered silicates and phosphate salts.

The compositions may for example comprise phosphate-containing builder material, preferably comprises tetrasodium pyrophosphate or even more preferably anhydrous sodium tripolyphosphate, present at a level of from 0.5% to 60%, more preferably from 5% to 50%, more preferably from 8% to 40.

Suitable water-soluble builder compounds include the water-soluble (poly)carboxylate salts and borates. The carboxylate or polycarboxylate builder can be monomeric or oligomeric in type although monomer polycarboxylates are generally preferred for reasons of cost and performance.

It may be preferred that the (poly)carboxylates and/or polymeric or oligomeric (poly)carboxylates are present at levels of less than about 5%, preferably less than about 3%, more preferably less than about 2%, or most preferably about 0% by weight of the compositions.

Examples of largely water insoluble builders include the sodium aluminosilicates.

Suitable aluminosilicate zeolites have the unit cell formula $Na_z[(AlO_2)_z(SiO_2)y]$. $xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from about 10% to 28%, and more preferably from about 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}].xH_2O$$

wherein x is from 20 to 30, especially 27. Zeolite X has the formula $Na_{86}[(AlO_2)_{86}(SiO_2)_{106}].276H_2O$.

Another preferred aluminosilicate zeolite is zeolite MAP builder. Zeolite MAP is described in EP 384070A (Unilever). It is defined as an alkali metal alumino-silicate of the zeolite P type having a silicon to aluminium ratio not greater than 1.33, preferably within the range from about 0.9 to 1.33 and more preferably within the range of from about 0.9 to 1.2.

The compositions herein may also comprise additional silicate material, including amorphous silicate material, meta-silicates, preferably at least crystalline layered silicate material such as sold under the trade name SKS-6. The silicate material is preferably present at a level of less than about 20% by weight of the compositions, preferably less than about 15% by weight, and more preferably less than about 10% by weight.

Heavy Metal Ion Sequestrant

Heavy metal ion sequestrant are also useful additional ingredients herein. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrants for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino-based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Enzyme

Another preferred ingredient useful herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from about 0.0001% to 4% active enzyme by weight of the composition.

Additional Organic Polymeric Compound

Additional organic polymeric compounds, not being the carboxylic acids herein, are preferred additional components of the compositions herein or the agglomerates herein, where they may act such as to bind the agglomerate components together.

By organic polymeric compound it is meant herein essentially any polymeric organic compound commonly used as binder, dispersants, and anti-redeposition and soil suspension agents in detergent compositions, including any of the high molecular weight organic polymeric compounds described as clay flocculating agents herein, including quaternized ethoxylated (poly) amine clay-soil removal/anti-redeposition agent in accord with the invention.

Organic polymeric compound is typically incorporated in the detergent compositions of the invention at a level of from about 0.01% to 30%, preferably from about 0.1% to 15%, and most preferably from about 0.5% to 10% by weight of the compositions.

Organic polymeric compounds suitable for incorporation in the detergent compositions herein include cellulose derivatives such as methylcellulose, sodium carboxymethylcellulose, hydroxypropylmethylcellulose and hydroxyethylcellulose. Highly preferred is also—or amide-modified carboxymethyl cellulose and—or amide-modified celluloses, or derivatives thereof Further useful organic polymeric compounds are the polyethylene glycols, particularly those of molecular weight 1000–10000, more preferably 2000 to 8000, and most preferably about 4000.

Suds Suppressing System

The detergent compositions of the invention, when formulated for use in machine washing compositions, may comprise a suds suppressing system present at a level of from about 0.01% to 15%, preferably from about 0.02% to 10%, and most preferably from about 0.05% to 3% by weight of the composition.

Suitable suds suppressing systems for use herein may comprise essentially any known antifoam compound, including, for example silicone antifoam compounds and 2-alkyl alcanol antifoam compounds.

Clay Softening Agents

The composition herein may be a detergent which provides softening through the wash. Preferred may be that the composition comprises a clay softening agent, and preferably also a flocculating agent.

Specific examples of suitable smectite clays include those selected from the classes of the montmorillonites, hectorites, volchonskoites, nontronites, saponites and sauconites, particularly those having an alkali or alkaline earth metal ion within the crystal lattice structure. Sodium or calcium montmorillonite are particularly preferred. Preferred are bentonite clays.

Preferred as clay flocculating agents herein are organic polymeric materials having an average weight of from about 100,000 to 10,000,000, preferably from about 150,000 to 5,000,000, and more preferably from about 200,000 to 2,000,000.

Suitable organic polymeric materials comprise homopolymers or copolymers containing monomeric units selected from alkylene oxide, particularly ethylene oxide, acrylamide, acrylic acid, vinyl alcohol, vinyl pyrrolidone, and ethylene imine. Homopolymers of ethylene oxide, acrylamide, and acrylic acid are preferred.

European Patents Nos. EP-A-299,575 and EP-A-313,146 in the name of the The Procter and Gamble Company describe preferred organic polymeric clay flocculating agents for use herein.

Other Optional Ingredients

Other optional ingredients suitable for inclusion in the compositions of the invention include perfumes (such as the encapsulated perfumes described above), brighteners, speckles (including colours or dyes), and filler salts, with sodium sulfate being a preferred filler salt.

Also, minor amounts (e.g., less than about 20% by weight) of neutralizing agents, additional buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued August 25, can be present.

| Abbreviations used in the examples | |
|---|---|
| LAS | Sodium linear C11–13 alkyl benzene sulfonate |
| TAS | Sodium tallow alkyl sulfate |
| CxyAS | Sodium C1x–C1y alkyl sulfate |
| C46SAS | Sodium C14–C16 secondary (2,3) alkyl sulfate |
| CxyEzS | Sodium C1x–C1y alkyl sulfate condensed with z moles of ethylene oxide |
| CxyEz | C1x–C1y predominantly linear primary alcohol condensed with an average of z moles of ethylene oxide |
| QAS | R2.N + (CH3)2(C2H4OH) with R2 = C12–C14 |
| QAS | R2.N + (CH3)2(C2H4OH) with R2 = C8–C11 |
| Soap | Sodium linear alkyl carboxylate derived from an 80/20 mixture of tallow and coconut fatty acids |
| STS | Sodium toluene sulphonate |
| STPP | Anhydrous sodium tripolyphosphate |
| Zeolite A | Hydrated sodium aluminosilicate of formula Na12(AlO2SiO2)12.27H2O having a primary particle size in the range from 0.1 to 10 micrometers (weight expressed on an anhydrous basis) |
| NaSKS-6 | Crystalline layered silicate of formula d-Na2Si2O5 average particle size of 25 microns |
| Carbonate | Anydrous sodium carbonate |
| Bicarbonate | Anhydrous sodium bicarbonate |
| Silicate | Amorphous sodium silicate (SiO2:Na2O = 2.0:1) |
| Sulfate | Anhydrous sodium sulfate |
| Mg sulfate | Anhydrous magnesium sulfate |
| Citrate | Tri-sodium citrate dihydrate |
| MA/AA | Copolymer of 1:4 maleic/acrylic acid, average molecular weight about 70,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase or proteolytic enzyme, having 4% |

-continued

| Abbreviations used in the examples | |
|---|---|
| | by weight of active enzyme, as described in WO 95/10591, sold by Genencor Int. Inc. |
| Amylase | Amylolytic enzyme, having 1.6% by weight of active enzyme, sold by NOVO Industries A/S under the tradename Termamyl 120T |
| Lipase | Lipolytic enzyme, having 2.0% by weight of active enzyme, sold by NOVO Industries A/S under the tradename Lipolase or lipolytic enzyme, having 2.0% by weight of active enzyme, sold by NOVO Industries A/S under the tradename Lipolase Ultra |
| PB4 | Particle containing sodium perborate tetrahydrate of nominal formula NaBO2.3H2O, the particles having a weight average particle size of 950 microns, 85% particles having a particle size of from 850 microns to 950 microns |
| PB1 | Particle containing anhydrous sodium perborate bleach of nominal formula NaBO2.H2O2, the particles having a weight average particle size of 800 microns, 85% particles having a particle size of from 750 microns to 950 microns |
| Percarbonate | Particle containing sodium percarbonate of nominal formula 2Na2CO3.3H2O2, the particles having a weight average particle size of 550 to 850 microns, 5% or less having a particle size of less than 300 microns and 7% or less having a particle size of more than 1180 microns |
| NOBS | Particle comprising nonanoyloxybenzene sulfonate in the form of the sodium salt, the particles having a weight average particle size of 550 microns to 900 microns |
| NAC-OBS | Particle comprising (6-nonamidocaproyl) oxybenzene sulfonate, the particles having a weight average particle size of from 550 microns to 900 microns |
| TAED I | Particle containing tetraacetylethylenediamine, the particles having a weight average particle size of from 550 microns to 900 microns |

-continued

| Abbreviations used in the examples | |
|---|---|
| DTPA | Diethylene triamine pentaacetic acid |
| DTPMP | Diethylene triamine penta (methylene phosphonate), marketed by Monsanto under the Tradename Dequest 2060 |
| Photoactivated | Sulfonated zinc phthlocyanine encapsulated in bleach (1) dextrin soluble polymer |
| Photoactivated | Sulfonated alumino phthlocyanine encapsulated in bleach (2) dextrin soluble polymer |
| Brightener | Disodium 4,4'-bis(2-sulphostyryl)biphenyl or Disodium 4,4'-bis(4-anilino-6-morpholino-1.3.5-triazin-2-yl)amino)stilbene-2:2'-disulfonate |
| EDDS | Ethylenediamine-N,N'-disuccinic acid, (S,S) isomer in the form of its sodium salt. |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidosole, with an average molecular weight of 20,000 |
| PVP | Polyvinylpyrrolidone polymer, with an average molecular weight of 60,000 |
| PVNO | Polyvinylpyrridine N-oxide polymer, with an average molecular weight of 50,000 |
| PVPVI | Copolymer of polyvinylpyrrolidone and vinyl-imidazole, with an average molecular weight of 20,000 |
| QEA | bis((C2H5O)(C2H4O)n)(CH3)-N + -C6H12-N + -(CH3) bis((C2H5O) – (C2H4O))n, wherein n = from 20 to 30 |
| SRP | Anionically endcapped poly esters |
| Silicone antifoam or suds suppresser | Polydimethylsiloxane foam controller with siloxane oxyalkylene copolymer as dispersing agent with a ratio of said foam controller to said dispersing agent of 10:1 to 100:1 |

In the following examples all levels are quoted as % by weight of the composition:

TABLE I

The following compositions are in accordance with the invention and have pH in the wash, as measured by the method defined herein, of around 9.4–9.85:

| | A | B | C | D | E | F | G | H | I | J | K |
|---|---|---|---|---|---|---|---|---|---|---|---|
| Spray-dried Granules | | | | | | | | | | | |
| LAS | 8.0 | 10.0 | 15.0 | 5.0 | 5.0 | 10.0 | — | — | — | | |
| TAS | — | 1.0 | — | 0.5 | 0.5 | | — | — | — | | |
| MBAS | 4.0 | — | | 5.0 | — | | — | — | — | | |
| $C_{45}$ AS | — | — | 1.0 | | 5.0 | 2.0 | | — | — | — | |
| $C_{45}$ $AE_3$ S | — | — | | 1.0 | 1.0 | | — | — | — | | |
| QAS | | | 1.0 | 1.0 | 1.0 | 1.0 | — | — | — | | |
| DTPA,HEDP and/or BDDS | 0.3 | 0.3 | 0.5 | 0.3 | 0.4 | — | — | — | — | | |
| MgSO4 | 0.5 | 0.5 | 0.1 | 0.1 | 0.1 | | — | — | — | | |
| Sodium carbonate | 3.0 | 7.0 | 5.0 | 4.0 | — | 3.0 | — | — | — | | |
| Sodium sulphate | — | — | — | — | 5.0 | 3.0 | — | — | — | | |
| Sodium | — | — | — | 0.3 | 2.0 | | — | — | — | | |

TABLE I-continued

The following compositions are in accordance with the invention and have pH in the wash, as measured by the method defined herein, of around 9.4–9.85:

| | A | B | C | D | E | F | G | H | I | J | K |
|---|---|---|---|---|---|---|---|---|---|---|---|
| silicate 1.6 R | | | | | | | | | | | |
| STPP | — | — | — | — | — | 16.0 | | | | | |
| Zeolite A | 16.0 | 18.0 | 20.0 | 20.0 | 10.0 | — | — | — | — | | |
| SKS-6 | 8.0 | — | — | | 5.0 | — | — | — | — | | |
| MA/AA or AA | 1.0 | 2.0 | — | — | — | 2.0 | — | — | — | | |
| PEG 4000 | — | 2.0 | — | | — | 1.0 | — | — | — | | |
| QEA | 1.0 | — | — | 1.0 | 1.0 | — | — | — | — | | |
| Brightener | 0.05 | 0.05 | 0.05 | — | 0.05 | — | — | — | — | | |
| Silicone oil | 0.01 | 0.01 | 0.01 | — | — | 0.01 | — | — | — | | |
| Agglomerate | | | | | | | | | | | |
| TAS | | | | | | | | 0.5 | 0.5 | — | 0.8 |
| LAS | 3.0 | | — | — | — | — | 6.0 | 2.0 | 8.0 | — | — |
| MBAS | | | — | — | — | — | 2.0 | — | 1.0 | 14.0 | 8.0 |
| $C_{45}AS$ | | | — | — | — | — | — | 4.0 | — | — | 4.0 |
| $C_{45}AE_3$ | | | — | — | — | — | 1.0 | 1.0 | 0.5 | — | 1.0 |
| Carbonate | 1.0 | | — | — | — | — | 6.0 | 7.0 | 5.0 | — | 3.0 |
| Sodium citrate | 2.0 | | — | — | — | — | — | — | 5.0 | | |
| Citric acid | 2.0 | | — | — | — | — | — | — | — | 9.0 | — |
| QEA | | | — | — | — | — | 2.0 | 1.0 | — | 1.0 | — |
| SRP | | | — | — | — | — | 1.0 | 0.2 | — | — | — |
| Zeolite A | 2.0 | — | — | — | | 20.0 | 15.0 | 18.0 | 15.0 | 25.0 | |
| Sodium silicate | | | — | — | — | — | — | 0.5 | 0.5 | — | — |
| PEG | — | — | — | — | — | — | 2.0 | — | — | — | — |
| MA/AA or AA | — | — | — | — | — | — | 3.0 | 4.0 | 1.0 | 1.0 | 0.8 |
| Builder Agglomerates | | | | | | | | | | | |
| SKS-6 | 6.0 | — | — | — | — | 3.0 | — | 7.0 | — | — | — |
| LAS | 4.0 | — | — | — | — | 3.0 | — | 6.0 | — | — | — |
| Dry-add particulate components | | | | | | | | | | | |
| Effervescence granule of carbonate/ bicarbonate/citric acid 1:1:1 | 10.0 | 15.0 | 15.0 | — | — | 12.0 | 2.0 | — | 15.0 | 12.0 | |
| Sodium bicarbonate | — | — | 4.0 | 2.0 | 4.0 | 2.0 | 7.0 | 8.0 | 3.0 | 4.0 | 5.0 |
| Sodium carbonate | 3.0 | — | 2.0 | 2.0 | — | — | — | — | — | 5.0 | |
| NOBS | 3.0 | 3.0 | 4.5 | — | — | — | — | — | 5.0 | — | — |
| TAED | 2.5 | 2.0 | — | 6.0 | 3.0 | 5.0 | — | 4.5 | — | 5.0 | — |
| NACA-OBS | — | — | — | — | 2.5 | — | — | — | — | | 4.5 |
| Citric acid | 5.0 | 5.0 | 3.0 | — | 8.0 | — | 10.0 | 7.0 | — | 7.0 | 10.0 |
| Maleic acid | — | — | — | 10.0 | | 10.0 | | | | | |
| Citrate | — | — | — | — | — | — | 3.0 | — | — | — | 2.0 |
| Percarbonate | 15.0 | 6.0 | 6.0 | 20.0 | — | — | 14.0 | 18.0 | 20.0 | 10.0 | 16.0 |
| PB1 and/or PB4 | — | 6.0 | — | — | 10.0 | 18.0 | — | — | — | | |
| Photobleach | 0.02 | 0.02 | 0.02 | 0.1 | 0.05 | — | 0.3 | — | 0.03 | | |
| Enzymes (amylase, protease, lipase) | 1.3 | — | 0.5 | 0.2 | 0.8 | 2.0 | 0.8 | 1.0 | 0.2 | 0.7 | — |
| Perfume (encapsulated) | — | 0.5 | 0.5 | — | 0.3 | 0.8 | 0.2 | 0.5 | — | 1.0 | 2.0 |
| Suds suppressor | 1.0 | 0.6 | 0.3 | — | 0.10 | 0.5 | 1.0 | 0.3 | 1.2 | 0.5 | 0.9 |
| Soap | 0.5 | 0.2 | 0.3 | 3.0 | 0.5 | — | — | 0.3 | — | — | — |
| SKS-6 | — | — | — | 4.0 | — | — | — | 6.0 | — | — | — |
| Bentonite clay | — | — | — | — | 8.0 | — | — | — | 10.0 | — | — |
| Dyed carbonate (blue, green) | 0.5 | 0.5 | 1.0 | 2.0 | — | 0.5 | 0.5 | 0.5 | 1.0 | 1.0 | — |
| Spray-on | | | | | | | | | | | |
| Brightener | 0.2 | 0.2 | 0.3 | 0.1 | 0.2 | 0.1 | — | 0.6 | 0.3 | | |
| Dye | — | — | — | 0.3 | 0.05 | 0.1 | — | — | — | | |

TABLE I-continued

| The following compositions are in accordance with the invention and have pH in the wash, as measured by the method defined herein, of around 9.4–9.85: | | | | | | | | | | | |
|---|---|---|---|---|---|---|---|---|---|---|---|
| | A | B | C | D | E | F | G | H | I | J | K |
| C25AE5 | — | — | — | — | — | 0.5 | — | 0.7 | — | | |
| Perfume | 1.0 | 0.5 | 1.1 | 0.8 | 0.3 | 0.5 | 0.3 | 0.5 | 0.8 | 0.5 | 1.0 |
| total balanced to 100% | | | | | | | | | | | |

What is claimed is:

1. A laundry or dishwashing detergent composition comprising a bleach system which contains a hydrogen peroxide source and at least about 2.5% by weight of at least two peroxyacid bleach precursors, wherein one of said peroxyacid bleach precursors is TAED and the second peroxyacid bleach precursor is NOBS, DOBS or NACA-OBS, at least about 15% by weight of a carbonate source, wherein said carbonate source may include said hydrogen peroxide source, at least about 7% by weight of an acid, whereby a 1% by weight mixture of said composition in demineralised water provides a pH from about 8.8 to 9.9.

2. The composition of claim 1 wherein the ratio of TAED to the second bleach cursor is from 1:2 to 2:1.

3. The composition of claim 1 wherein said acid is an organic acid and whereby said carbonate source comprises at least 5% by weight of the composition of an alkali or earth alkali carbonate salt, at least 8% by weight of the composition of an alkali or earth alkali percarbonate salt and at least 2% by weight of the composition of an alkali or earth alkali bicarbonate salt.

4. The composition of claim 3 wherein said organic acid is carboxylic acid.

5. The composition of claim 4 wherein said carboxylic acid is citric acid, maleic acid, malic acid, or a mixture thereof.

6. The composition of claim 1 whereby said peroxyacid bleach precursor is present at a level about 3% to 10% by weight of the composition and whereby the composition comprises from about 10% to 45% by weight of the hydrogen peroxide source.

7. The composition of claim 6 whereby said hydrogen peroxide source is a percarbonate salt which forms part of said carbonate source.

8. The composition of claim 1 whereby said pH is from about 9.2 to 9.85.

9. The composition of claim 1 wherein said composition comprises a granule whereby said granule comprises said precursor or part thereof and a carbonate salt, percarbonate salt and/or a bicarbonate salt.

10. The composition of claim 9 wherein said precursor and said salt arc in the form of an intimate, homogeneous mixture with one another, said granule being substantially free of the acid.

11. The composition of claim 1 comprising a granule wherein said granule contains said acid or part thereof and carbonate and/or bicarbonate salt present in said carbonate source.

12. The composition of claim 11 wherein said acid and said carbonate and/or said bicarbonate are present in the form of an intimate, homogeneous mixture with one another.

13. The composition of claim 1 comprising a perfume component which contains a mixture of perfume oils encapsulated by an encapsulating agent.

14. The composition of claim 13 wherein said encapsulating agent comprises a starch or starch derivative.

15. A method for washing textiles in a washing machine said method comprising, (A) providing a composition, said composition comprising, a bleach system which contains a hydrogen peroxide source and at least about 2.5% by weight of a peroxyacid bleach precursor, at least about 15% by weight of a carbonate source, wherein said carbonate source may include said hydrogen peroxide source, at least about 7% by weight of an acid, whereby a 1% by weight mixture of said composition in demineralised water provides a pH from about 8.8 to 9.9;

(B) introducing said composition into a dispensing device;

(C) introducing said dispensing device into the drum of a washing machine; and (D) adding wash water into said washing machine.

16. The method of claim 15 wherein said textile washing reduces the activity of microorganisms.

17. The method of claim 16 wherein said microorganisms are bacteria.

18. The method of claim 17 wherein said bacteria is *E Coli, E Hirae, S Aureus*, or *Ps Aruginosa.*

19. The method of claim 18 whereby the activity of at least one of the bacteria is reduced by at least $10^5$ as measured by the CEN method.

20. The method of claim 19 herein said bacteria contacts an aqueous liquor comprising an amount of said composition such that said peroxyacid bleach precursor is present at a level of at least 100 ppm in said liquor, per $10^6$ microorganism.

* * * * *